US006966796B2

(12) United States Patent
Abe et al.

(10) Patent No.: US 6,966,796 B2
(45) Date of Patent: Nov. 22, 2005

(54) CONNECTOR

(75) Inventors: Kimihiro Abe, Haibara-gun (JP); Tohru Ikumi, Haibara-gun (JP); Syuji Kimura, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/984,966

(22) Filed: Nov. 10, 2004

(65) Prior Publication Data

US 2005/0118866 A1 Jun. 2, 2005

(30) Foreign Application Priority Data

Nov. 10, 2003 (JP) ..... P2003-379591

(51) Int. Cl.[7] ..... H01R 9/05
(52) U.S. Cl. ..... 439/585; 439/903
(58) Field of Search ..... 439/585, 578, 439/610, 669, 903

(56) References Cited

U.S. PATENT DOCUMENTS 3,966,292 A * 6/1976 Schultz ..... 439/578
5,562,506 A * 10/1996 Wright ..... 439/675
6,808,417 B2 * 10/2004 Yoshida ..... 439/585
2004/0121649 A1 * 6/2004 Endo et al. ..... 439/578

FOREIGN PATENT DOCUMENTS

JP 64-9375 U 1/1989
JP 2-277884 U 6/1990
JP 3-4476 U 1/1991

* cited by examiner

*Primary Examiner*—Phuong Dinh
(74) *Attorney, Agent, or Firm*—Sughrue Mion, PLLC

(57) ABSTRACT

A connector includes an insulative holding member having a generally-cylindrical tubular shape, and a conductive shielding member which includes a cover portion for covering an outer peripheral face of the holding member and a clamping portion. The holding member has a receiving portion. The cover portion has an engaging portion which engages with the receiving portion. The holding member has a guide groove for guiding the engaging portion to the receiving portion, the guide groove extending from an end portion of the holding member along a first direction in which the holding member extends. The guide groove has a first end and a second end, the first end disposed on the end portion of the holding member, and the second end disposed so as to opposed to the first end. A width of the guide groove gradually increases toward the first end to the second end.

5 Claims, 3 Drawing Sheets

CONNECTOR

BACKGROUND OF THE INVENTION

This invention relates to a connector for a coaxial cable, and more particularly to a connector suited for enhancing the efficiency of assembling of constituent parts thereof.

Generally, in order to shield the electrical noise such as electromagnetic waves and static electricity, a coaxial cable, used as an antenna wire or the like, has a construction in which a conductor, covered with an inner insulating layer, is covered with a braid, and further this braid is covered with an insulating sheath. There have been proposed various connectors for connecting such a coaxial cable to a mating equipment or a mating connector (see, for example, JP-UM-A-64-9375 (Page 5, FIG. 1), JP-UM-A-2-77884 (FIG. 1), and JP-UM-A-3-476 (FIG. 1)).

In a pin plug (corresponding to a coaxial cable connector of the present invention) disclosed in JP-UM-A-64-9375, in order that a cover 30 can be attached to a tubular body 10 (corresponding to a holding member in the invention) for receiving a pin in a fixed manner, notches 14 of a predetermined width (corresponding to grooves in the invention) are formed in the tubular body 10, while projected piece portions 32 (corresponding to claws in the invention) are formed on the cover 30, and the projected piece portions 32 are engaged respectively in the notches 14, thereby assembling the two parts (that is, the body and the cover of the above construction) together. When the cover is attached to the body, each projected piece portion of the cover is aligned with an inlet of the notch, and then the cover is pushed to be fitted on the body. The projected piece portion advances into a predetermined position along the notch, and is retained there.

By the way, the body has the guide grooves formed respectively in upper and lower sides thereof. The cover has the claws formed respectively on upper and lower sides thereof. When the cover is attached to the body by using the grooves and the claws, first, one of the claws is aligned with the corresponding guide groove, and the one of the claws is fitted into the corresponding guide groove. However, gap is provided between the claw and the guide groove, and therefore there is a fear that the cover rolls relative to the body. When such rolling occurs, the other claw fails to be fitted into the other guide groove, and the other claw slides onto the outer surface of the body, so that the assembling operation can not be continued. In a result, a problem is invited that the aligning operation must be performed again. There is a possibility that such sliding-on due to the rolling occurs even during the fitting of the cover onto the body with the claws moving along the respective guide grooves.

SUMMARY OF THE INVENTION

This invention seeks to solve the above problem, and an object of the invention is to provide a coaxial cable connector in which constituent parts of the connector (that is, a holding member for fixing a plug terminal and a shielding member including a cover portion for covering the holding member, and a clamping portion for fixing a coaxial cable) can be easily assembled together through grooves, formed in the holding member, and claws formed on the cover portion of the shielding member, so that the efficiency of the assembling operation is excellent.

In order to achieve the above object, according to the present invention, there is provided a connector, comprising:

an insulative holding member for holding a terminal, and the holding member having a generally-cylindrical tubular shape; and a conductive shielding member which includes a cover portion for covering an outer peripheral face of the holding member, and a fixing portion for fixing a coaxial cable for electrical connection to the terminal, wherein the holding member has a receiving portion;

wherein the cover portion has an engaging portion which engages with the receiving portion;

wherein the holding member has a guide groove for guiding the engaging portion to the receiving portion, the guide groove being extended from an end portion of the holding member along a first direction in which the holding member extends;

wherein the guide groove has a first end and a second end, the first end disposed on the end portion of the holding member, and the second end disposed so as to be opposed to the first end; and wherein a width of the guide groove gradually increases toward the first end to the second end.

Preferably, the holding member has a slope face for guiding the engaging portion to the receiving portion. The slope face is disposed between the receiving portion and the guide groove.

Preferably, the receiving portion is a receiving groove having a rectangular shape in cross-section. The receiving groove is formed on the outer face of the holding member.

Here, it is preferable that, a width of the receiving groove is substantially equal to that of the second end of the guide groove.

Preferably, the holding member has a flange portion. When the engagement portion is engaged with the receiving portion, an end portion of the cover portion of the shielding member is abutted against the flange portion.

According to the present invention, there is also provided a generally-cylindrical tubular insulative holding member for fixedly holding a plug terminal in such a manner that the plug terminal projects forwardly from a bore of a cylindrical body of the holding member, and a metallic shielding member which includes a cover portion for covering an outer peripheral surface of the cylindrical body to shield the same, and a clamping portion for fixing a coaxial cable for electrical connection to the plug terminal which clamp portion is formed at a rear portion of the shielding member connected to the cover portion; characterized in that a first groove of a rectangular cross-section is formed in an outer surface of the cylindrical body of the holding member, and extends rearwardly from a front end of the cylindrical body in parallel relation to an axis thereof, and a second groove is formed in the outer surface of the cylindrical body, and extends to a rear end of the cylindrical body in such a manner that the second groove is spaced a predetermined distance from a rear end of the first groove, and a width of the second groove is equal at its front end to the width of said first groove, and is increasing gradually toward the rear end of the cylindrical body, and a front end portion of the second groove slopes from the outer surface of the cylindrical body to a bottom of the second groove, and the cover portion of the shielding member has a generally cylindrical tubular shape, and a claw is formed at a tubular body of the cover portion, and projects into the interior of the tubular body, and the claw is so disposed that when a front end of the tubular body of the cover portion of the shielding member reaches that portion of the bore of the cylindrical body receiving the plug terminal, the claw becomes fitted in the first groove.

For assembling the holding member and the shielding member together, generally, first, the claw, formed at the tubular cover portion of the shielding member, is aligned with a groove inlet (rear open end) of the second groove formed in the cylindrical body of the holding member, and is fitted into the second groove. In this condition, the cover portion is pushed to be advanced relative to the holding member. The claw, while resiliently deformed, slides upwardly along the slope at the front end portion of the second groove, and then the claw slides onto the outer surface of the cylindrical body, and further advances a small distance to become fitted in the first groove. As a result, the shielding member is attached in a predetermined position to the holding member.

The width of the second groove is increasing gradually toward the rear end thereof, and therefore the claw can be more easily aligned with the inlet of the groove as compared with a groove having parallel side walls. Even when the cover portion rolls during the advancing movement of the claw, the claw is easily kept in the groove since the groove is increasing in width gradually toward the rear end, and the daw is prevented from sliding onto the outer surface of the cylindrical body, and therefore the holding member and the shielding member can be easily assembled together.

The holding member has flange piece portions formed on and projecting outwardly respectively from left and right sides (when the bore is viewed from the front side) of the outer peripheral surface of the cylindrical body at the front end portion thereof, and the claw is fitted in the first groove, with the front end of the tubular body of the cover portion abutted against rear surfaces of the flange piece portions.

The two first grooves are formed respectively in upper and lower portions of the outer surface of the cylindrical body of the holding member, and the two claws are formed respectively at upper and lower portions of the outer surface of the tubular body of the cover portion of the shielding member.

With these constructions, the holding member and the shielding member can be assembled together more easily.

In the present invention, the constituent parts of the coaxial cable connector (that is, the holding member for fixing the plug terminal and the shielding member including the cover portion for covering the holding member, and the clamping portion for fixing a coaxial cable) can be easily assembled together.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
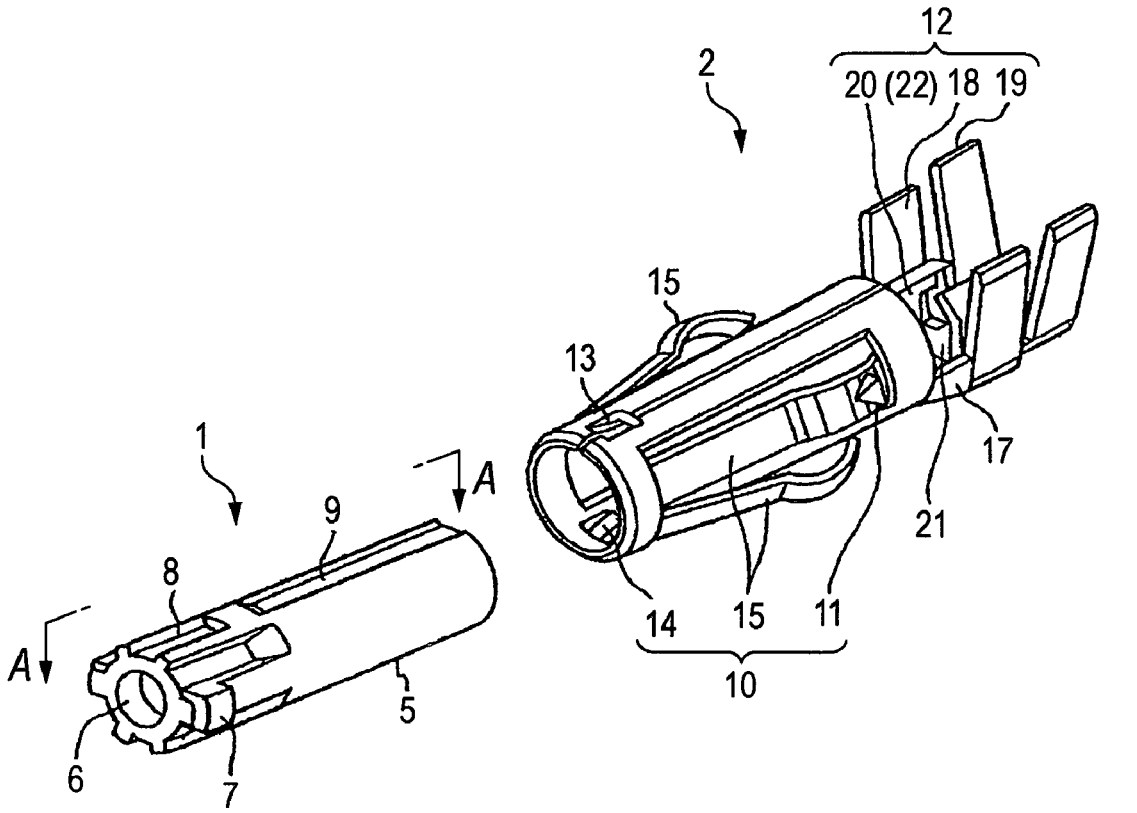
FIG. 1 is a perspective view showing a broad construction of a coaxial cable connector according to one preferred embodiment of the present invention.
Figure 2A:
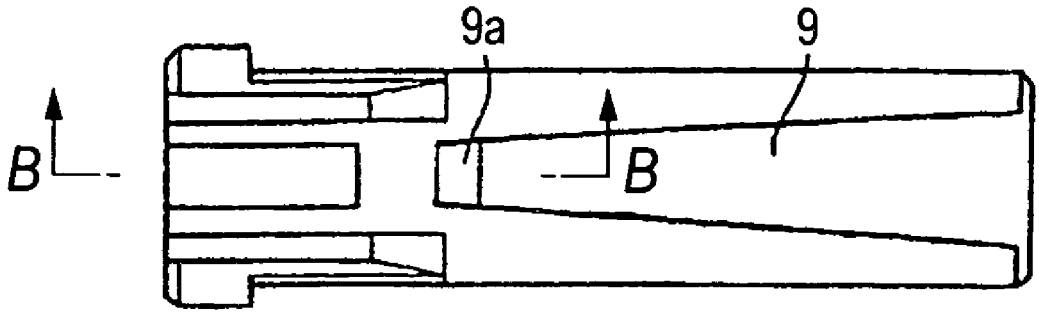
FIGS. 2A and 2B are views as seen in a direction of the line II—II of FIG. 1.
Figure 2B:
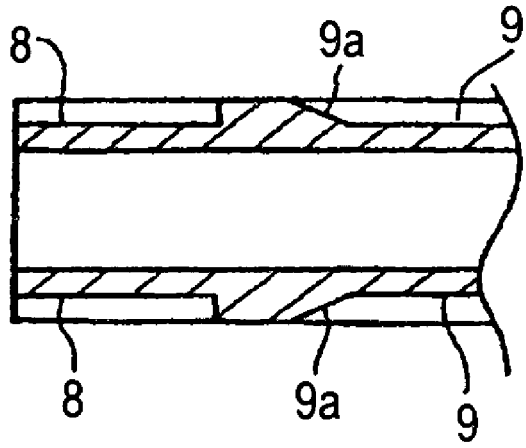
Figure 3:
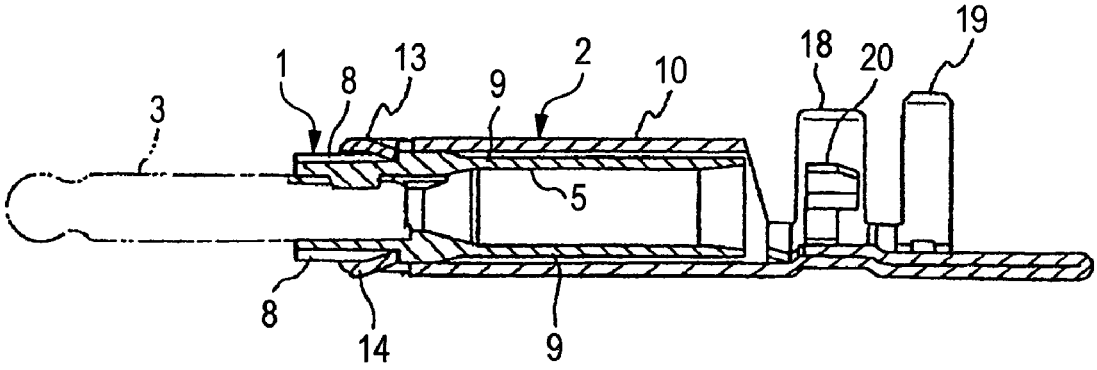
FIG. 3 is a longitudinal cross-sectional view of the assembled condition of the coaxial cable connector of the embodiment.

One preferred embodiment of a coaxial cable connector of the present invention will now be described with reference to FIGS. 1 to 3. FIG. 1 is a perspective view showing constituent parts of the coaxial cable connector of this embodiment, FIGS. 2A and 2B are views as seen in a direction of the line II—II of FIG. 1, and FIG. 3 is a longitudinal cross-sectional view of the coaxial cable connector in its assembled condition.

The coaxial cable connector of this embodiment includes a cylindrical tubular holding member 1 for holding a plug terminal 3 in such a manner that the plug terminal 3 projects from a front end of a cylindrical body of the holding member 1, and a shielding member 2 which includes a cover portion for receiving the cylindrical body of the holding member 1, and a clamping metal portion connected to a rear end of the cover portion so as to press-clamp a coaxial cable 4. The holding member 1 is made of an insulative material, and the shielding member 2 is made of metal.

The plug terminal 3 is inserted in a front end portion of a bore 6 of the generally-cylindrical tubular body 5 of the holding member 1, and is fixed thereto. Flange piece portions 7 are formed on and project outwardly respectively from left and right sides (when the bore 6 is viewed from the front side) of an outer peripheral surface of the cylindrical body 5 at the front end portion thereof, and a pair of grooves 8 (first groove or receiving portion) are formed respectively in upper and lower portions of the outer peripheral surface of the cylindrical body 5, and extend rearwardly from the front end of this cylindrical body 5 in parallel relation to an axis thereof. Further, another pair of grooves 9 (second groove or guide groove) are formed in the outer peripheral surface of the cylindrical body 5, and extend to the rear end of the cylindrical body 5 in such a manner that the grooves 9 are spaced a predetermined distance from rear ends of the grooves 8, respectively. The grooves 8 serve as retaining grooves for respectively retaining claws 13 which are formed on the cover portion 11 of the shielding member 2 so as to fix the shielding member 2 to the holding member 1. The other grooves 9 serve as guide grooves for guiding the claws 13 respectively to the retaining grooves 8. The retaining groove 8 is shallow, and has a rectangular cross section, and has a uniform width throughout the length thereof. On the other hand, the guide groove 9 has the same depth as that of the retaining groove 8, but the width of the guide groove 9 becomes greater along the extension direction of the guide groove 9 such that the width of the guide groove 9 is equal at its front end to the width of the retaining groove 8, and is increasing gradually toward the rear end of the cylindrical body 5. A centerline (axis) of the retaining groove 8 and a centerline (axis) of the corresponding guide groove 9 are disposed on a common straight line. The rear end of the retaining groove 8 is abruptly deepened in a direction perpendicular to the outer surface of the cylindrical body 5, while the front end portion of the guide groove 9 is formed into a sloping shape, and the depth of the front end potion of the guide groove 9 from the outer surface of the cylindrical body 5 to its bottom is increasing gradually in a direction away from its front end.

The shielding member 2 includes the cover portion 10 for receiving the cylindrical body 5 of the holding member 1, and the press-clamping metal portion 12 extending rearwardly from a bottom portion of a rear end of the cover portion 10 so as to press-clamp the coaxial cable 4.

The cover portion 10 of the shielding member 2 has a generally tubular shape, and the claw 13 is formed at an upper portion of a front end portion of a tubular body 11 thereof. The claw 13 projects into the interior of the tubular body 11. Another claw 14 is formed at a lower portion of the front end portion of the tubular body 11 and is disposed in symmetrical relation to the claw 13 (formed at the upper portion of the tubular body 11) with respect to the axis of the tubular body 11. The bending depth and the width of each of the claws 13 and 14 are so determined that the claws 13 and 14 can be smoothly fitted respectively into the corresponding retaining grooves 8. The cover portion 10 has four leaf-like spring piece portions 15 provided at the outer surface thereof, and the spring piece portions 15 first project outwardly from the outer surface of the tubular body 11 to extend in the longitudinal direction of the tubular body 11, and then are curved to be directed toward the outer surface of the tubular body 11. The spring piece portions 15 are used for attaching a protective cover (not shown) to the shielding member 2, and the curved portions of the spring piece portions 15 are fitted respectively in slots formed in the protective cover, thereby attaching the protective cover to the shielding member.

The press-clamping metal portion 12 includes a generally-flat base plate 17 extending rearwardly from the bottom portion of the rear end of the cover portion 10, first press-clamping plates 18 extending upwardly respectively from opposite side edges of the base plate 17, and second press-clamping plates 19 which are disposed rearwardly of the first press-clamping plates 18, and extend upwardly respectively from the opposite side edges of the base plate 17. A small piece portion 20 is formed on the base plate 17, and is disposed between the first press-clamping plates 18 and 18. This small piece portion 20 includes a bottom plate 21, and side plates 22 which first extend upwardly respectively from opposite side edges of the bottom plate 21, and then slant toward each other at their distal end portions. The whole of the shielding member 2 from the front cover portion 10 to the rear second press-clamping plates 19 except the small piece portion 20 is press-ut or blanked from a sheet, and then that portion of the sheet, corresponding to the cover portion 10, is bent into a tubular shape to form the cover portion 10. Therefore, a slit remains in the top of the cover portion 10. The small piece portion 20 is joined to the base plate 17. Although the claw 13, formed at the upper portion of the cover portion 10, is divided into right and left sections by the slit, this is merely for processing reasons, and the claw 13 has the same length, width and function as the claw 14 of an integral construction formed at the lower portion of the cover portion 10.

Next, the procedure of assembling the holding member 1 and the shielding member 2 together will be described. First, the claws 13 and 14, formed at the front end portion of the cover portion 10 (that is, the tubular body 11), are aligned respectively with the groove inlets (rear open ends) of the two tapering guide grooves 9 formed on the cylindrical body 5 of the holding member 1, and are fitted respectively into the guide grooves 9. In this condition, the shielding member 1 is pushed to be advanced relative to the holding member 1. Each claw 13, 14, while resiliently deformed, slides along the slope 9*a* at the front end portion of the guide groove 9, and then the claw slides onto the outer surface of the cylindrical body 5, and further advances a small distance to become fitted in the retaining groove 8. At this time, the front end of the tubular body 11 is held against the flange piece portions 7 on the holding member 1. Therefore, the shielding member 1 is restrained by the four portions of the holding member 1, that is, the right and left flange piece portions 7 and the upper and lower retaining grooves 8, and is fixed.

The guide groove 9 is tapering in width such that a width of the groove inlet thereof is wider than that of the groove having side walls, and therefore the alignment of the claw with the guide groove can be easily effected. During the time when the upper and lower claws 13 and 14 of the cover portion 10 move respectively along the upper and lower guide grooves 9, the gap is provided between the upper claw 13 and the upper guide groove 9, while the gap is provided between the lower claw 14 and the lower guide groove 9, and therefore the cover portion 10 rolls because of the gap. However, the upper and lower guide grooves 9 are tapering in width, and therefore even when the cover portion 10 rolls, the upper and lower claws 13 and 14 are easily kept in the guide grooves 9, respectively. As a result, the two claws 13 and 14 will not slide onto the outer surface of the cylindrical body 5 of the holding member 1, and the assembling operation can be carried out easily. And besides, since each of the guide grooves 9 is tapering in width, the claws 13 and 14 are aligned respectively with the inlets of the upper and lower grooves 9 without looseness, and when each claw 13, 14 shifts from the guide groove 9 into the retaining groove 8, the claw is prevented from deviating from the retaining groove 8, and therefore will not run onto the outer surface of the cylindrical body 5, so that the efficiency of the connector assembling operation can be enhanced.

Figure 4:
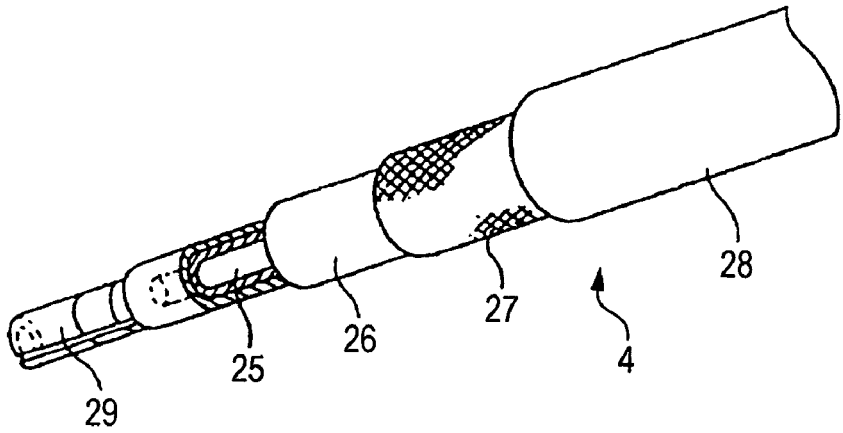
FIG. 4 is a perspective view showing the construction of a coaxial cable.

Finally, the connection between the connector (including the holding member 1 and the shielding member 2) and the coaxial cable will be described. As shown in FIG. 4, the coaxial cable 4 has a multi-layer covering structure in which an inner insulating layer 26, a braid 27 and an insulating sheath 28 are sequentially wound on a conductor 25 disposed at an axis of the coaxial cable. Further, a generally-cylindrical inner terminal 29, receiving a distal end portion of the conductor 25 therein, is press-connected to the coaxial cable. A distal end portion of the inner insulating layer 26, covering the conductor 26, extends in an exposed manner from the braid 27, and a distal end portion of the braid 27 extends in an exposed manner from the insulating sheath 28. For connecting the coaxial cable to the connector, the inner terminal 29 is inserted into the connector until it is brought into abutting engagement with the plug terminal 3 fixedly received in the cylindrical body 5 of the holding member 1. At this time, rear portions of the side plates 22 of the small piece portion 20 are inserted in a gap between the inner insulating layer 26 and the front end portion of the braid 27, and in this condition the exposed portion of the braid 27 is press-gripped by the first press-clamping plates 18 and 18 of the shielding member 1, while the front end portion of the insulating sheath 28 is press-ripped by the second press-clamping plates 19 and 19 of the shielding member 1. The small piece portion 20 prevents the braid 27 from being excessively deformed by this press-clamping operation.

What is claimed is:

1. A connector, comprising:

an insulative holding member for holding a terminal, and the holding member having a generally-cylindrical tubular shape; and a conductive shielding member which includes a cover portion for covering an outer peripheral face of the holding member, and a fixing portion for fixing a coaxial cable for electrical connection to the terminal;

wherein the holding member has a receiving portion;

wherein the cover portion has an engaging portion which engages with the receiving portion;

wherein the holding member has a guide groove for guiding the engaging portion to the receiving portion, the guide groove being extended from an end portion of the holding member along a first direction in which the holding member extends;

wherein the guide groove has a first end and a second end, the first end disposed on the end portion of the holding member, and the second end disposed so as to be opposed to the first end; and wherein a width of the guide groove gradually increases toward the first end to the second end.

2. The connector as set forth in claim 1, the holding member has a slope face for guiding the engaging portion to the receiving portion; and wherein the slope face is disposed between the receiving portion and the guide groove.

3. The connector as set forth in claim 1, wherein the receiving portion is a receiving groove having a rectangular shape in cross-section; and wherein the receiving groove is formed on the outer face of the holding member.

4. The connector as set forth in claim 3, wherein a width of the receiving groove is substantially equal to that of the second end of the guide groove.

5. The connector as set forth in claim 1, wherein the holding member has a flange portion; and wherein when the engagement portion is engaged with the receiving portion, an end portion of the cover portion of the shielding member is abutted against the flange portion.

* * * * *